US011877705B1

(12) United States Patent
Grasseschi

(10) Patent No.: US 11,877,705 B1
(45) Date of Patent: Jan. 23, 2024

(54) COLLAPSIBLE AND HEIGHT ADJUSTABLE SHOWER CHAIR DEVICE

(71) Applicant: Robbie Grasseschi, Irvine, CA (US)

(72) Inventor: Robbie Grasseschi, Irvine, CA (US)

( * ) Notice: Subject to any disclaimer, the term of this patent is extended or adjusted under 35 U.S.C. 154(b) by 0 days.

(21) Appl. No.: 17/884,513

(22) Filed: Aug. 9, 2022

(51) Int. Cl.
*A47K 3/28* (2006.01)

(52) U.S. Cl.
CPC ..... *A47K 3/282* (2013.01)

(58) Field of Classification Search
CPC . A47K 3/282; A47D 1/00; A47D 1/02; A47D 1/008
USPC ..... 4/611
See application file for complete search history.

(56) References Cited

U.S. PATENT DOCUMENTS 2,517,004 A * 8/1950 Little ..... A47D 1/023 297/30
2,902,084 A * 9/1959 Stevens ..... A47D 1/023 297/29
4,036,523 A * 7/1977 Nielsen ..... A47D 1/04 297/130
7,600,810 B2 * 10/2009 Chen ..... A47D 1/023 297/56
10,034,555 B1 * 7/2018 Van den Akker ..... A47C 4/02
2007/0194609 A1 * 8/2007 Chen ..... A47D 1/023 297/16.1
2015/0313418 A1 * 11/2015 Yassa ..... A47D 1/004 4/611
2016/0331189 A1 * 11/2016 Yassa ..... A47K 3/282
2018/0206649 A1 * 7/2018 Homan ..... A47D 13/107

* cited by examiner

*Primary Examiner* — Huyen D Le
(74) *Attorney, Agent, or Firm* — Pharar Patents & Intellectual Property; Andrew A. Pharar

(57) ABSTRACT

The collapsible and height adjustable shower chair device disclosed herein may allow a user to seat and support a child while in the shower for washing. The device may collapse down into a form factor suitable for storing away, while also providing a height adjustment so that a child is placed at an appropriate height for where a second user may attend to the child. The feet of the device may provide traction and stability to the collapsible and height adjustable shower chair device so that it does not slide on a wet surface and so that it does not tilt forward due to the child shifting their weight. The device may further comprise safety features such as, for example, side bolsters or a seat belt to prevent a child from falling out of the device.

6 Claims, 13 Drawing Sheets

COLLAPSIBLE AND HEIGHT ADJUSTABLE SHOWER CHAIR DEVICE

TECHNICAL FIELD OF THE INVENTION

The present invention relates in general to foldable chairs, and, more specifically, to a collapsible and height adjustable shower chair device.

COPYRIGHT AND TRADEMARK NOTICE

A portion of the disclosure of this patent application may contain material that is subject to copyright protection. The owner has no objection to the facsimile reproduction by anyone of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and should not be construed as descriptive or to limit the scope of this invention to material associated only with such marks.

BACKGROUND OF THE INVENTION

A seat is a piece of furniture with a raised surface supported by legs, commonly used to seat a single person. Seats may vary in their design and number of legs, though generally comprise a relatively horizontal surface having three to five relatively vertical legs for support. A seat further comprising a relatively vertical support surface may be known as a chair. Seats and chairs may comprise a variety of materials of construction, though are commonly made from plastics, metals, woods, or some combination thereof. Seats and chairs may be further padded or upholstered or may comprise removably attached cushions for additional user comfort.

A folding seat is a seat that folds upon itself into a more compact form so as to occupy less space. Such a seat may be mounted to a vertical surface and may articulate up or down, or may be unmounted and may articulate relative to its vertical legs. A folding chair may be designed so that a chair back and chair seat may articulate relative to one another, and may further articulate relative to the vertical legs or may incorporate the vertical legs into the articulating action. Many folding chairs articulate at the seat, forming a side-x design, wherein the chair back support and the front legs are the same component, while other folding chairs articulate at a single attachment point relative to the seat, forming a side-z design.

A number of chairs may be used for supporting a first user while a second user attends to the first user. By way of example, a high chair may be a chair suitable for receiving a small child and elevating the child off the ground. The child may be secured into the chair by a belt, a tray, or a bar, and the chair may further comprise elements that may allow the child to eat, drink, or be fed while seated. A shower chair, on the other hand, may allow a child to be seated in the shower while a second user washes and cleans the child. Such high chairs and shower chairs, though, do not fold down into a suitably compact form for ease of carrying or storage by a user, especially a user that may be otherwise encumbered by goods or may wish to store the chair away when not in use.

Thus, there is a need in the art for a collapsible and height adjustable shower chair device that collapses down into a form factor suitable for storing away, while also providing a height adjustment so that a child is placed at an appropriate height for where a second user may attend to the child. The device may further comprise safety features such as, for example, side bolsters or a seat belt to prevent a child from falling out of the device. It is to these ends that the present invention has been developed.

BRIEF SUMMARY OF THE INVENTION

To minimize the limitations in the prior art, and to minimize other limitations that will be apparent upon reading and understanding the present specification, the present invention describes a collapsible and height adjustable shower chair device.

It is an objective of the present invention to provide a collapsible and height adjustable shower chair device that may comprise a main body.

It is an objective of the present invention to provide a collapsible and height adjustable shower chair device that may comprise a seat assembly.

It is an objective of the present invention to provide a collapsible and height adjustable shower chair device that may comprise a horizontal surface.

It is an objective of the present invention to provide a collapsible and height adjustable shower chair device that may comprise a vertical surface.

It is an objective of the present invention to provide a collapsible and height adjustable shower chair device that may comprise a fabric seat.

It is an objective of the present invention to provide a collapsible and height adjustable shower chair device that may comprise seat frame.

It is another objective of the present invention to provide a collapsible and height adjustable shower chair device that may comprise a plurality of upper legs.

It is another objective of the present invention to provide a collapsible and height adjustable shower chair device that may comprise a plurality of lower legs.

It is another objective of the present invention to provide a collapsible and height adjustable shower chair device that may comprise a plurality of means for leg length adjustment.

It is another objective of the present invention to provide a collapsible and height adjustable shower chair device that may comprise a plurality of means for leg angle adjustment.

It is another objective of the present invention to provide a collapsible and height adjustable shower chair device that may comprise a locking mechanism.

It is another objective of the present invention to provide a collapsible and height adjustable shower chair device that may comprise a resilient material of construction.

It is another objective of the present invention to provide a collapsible and height adjustable shower chair device that may comprise a water-proof material of construction.

It is another objective of the present invention to provide a collapsible and height adjustable shower chair device that may comprise a reusable material of construction.

It is another objective of the present invention to provide a collapsible and height adjustable shower chair device that may comprise a multi-component construction.

It is another objective of the present invention to provide a collapsible and height adjustable shower chair device that may comprise an antimicrobial layer.

It is another objective of the present invention to provide a collapsible and height adjustable shower chair device that may comprise an antimicrobial material of construction.

These and other advantages and features of the present invention are described herein with specificity so as to make the present invention understandable to one of ordinary skill in the art, both with respect to how to practice the present invention and how to make the present invention.

BRIEF DESCRIPTION OF THE SEVERAL VIEWS OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

DETAILED DESCRIPTION OF THE INVENTION

Certain terminology is used in the following description for reference only and is not limiting. The words "front," "rear," "anterior," "posterior," "lateral," "medial," "upper," "lower," "outer," "inner," and "interior" refer to directions toward and away from, respectively, the geometric center of the invention, and designated parts thereof, in accordance with the present disclosure. Unless specifically set forth herein, the terms "a," "an," and "the" are not limited to one element, but instead should be read as meaning "at least one." The terminology includes the words noted above, derivatives thereof, and words of similar import.

The collapsible and height adjustable shower chair device disclosed herein may allow a user to seat and support a child while in the shower for washing. The device may collapse down into a form factor suitable for storing away, while also providing a height adjustment so that a child is placed at an appropriate height for where a second user may attend to the child. The feet of the device may provide traction and stability to the collapsible and height adjustable shower chair device so that it does not slide on a wet surface and so that it does not tilt forward due to the child shifting their weight. The device may further comprise safety features such as, for example, side bolsters or a seat belt to prevent a child from falling out of the device.

Figure 1:
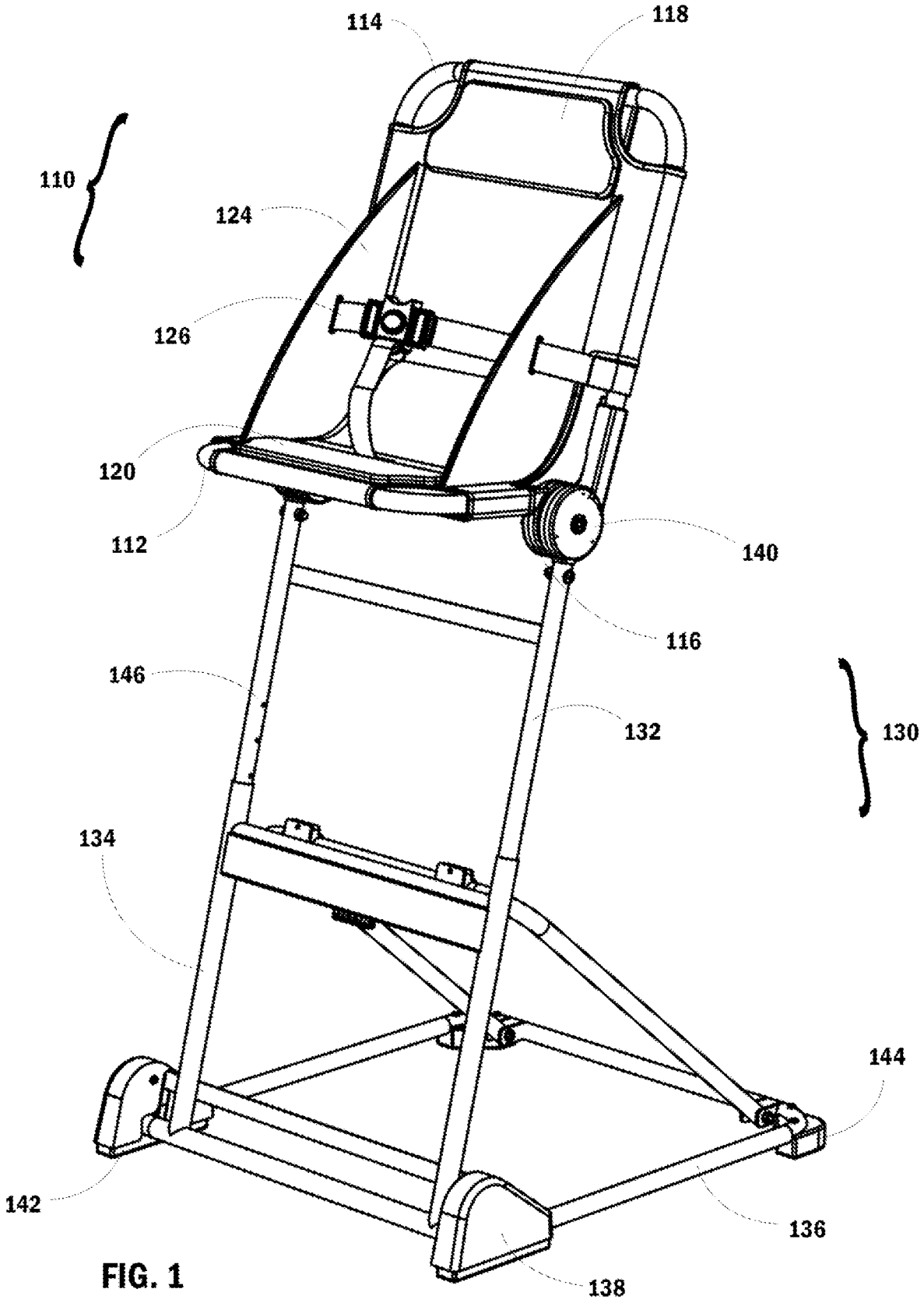
FIG. 1 is a front left isometric perspective view of a collapsible and height adjustable shower chair device, as contemplated by the present disclosure.
Figure 2:
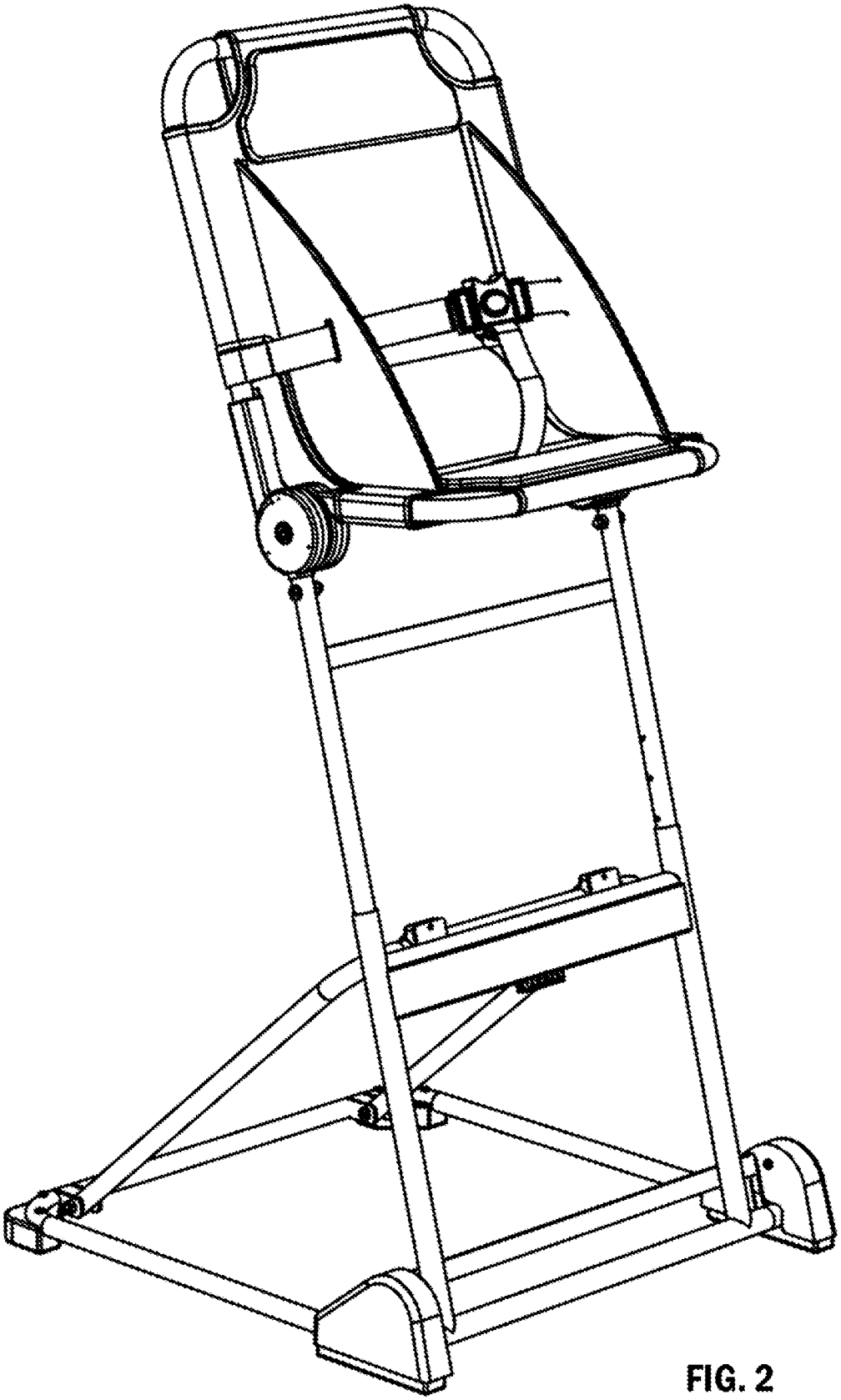
FIG. 2 is a front right isometric perspective view of a collapsible and height adjustable shower chair device, as contemplated by the present disclosure.
Figure 3:
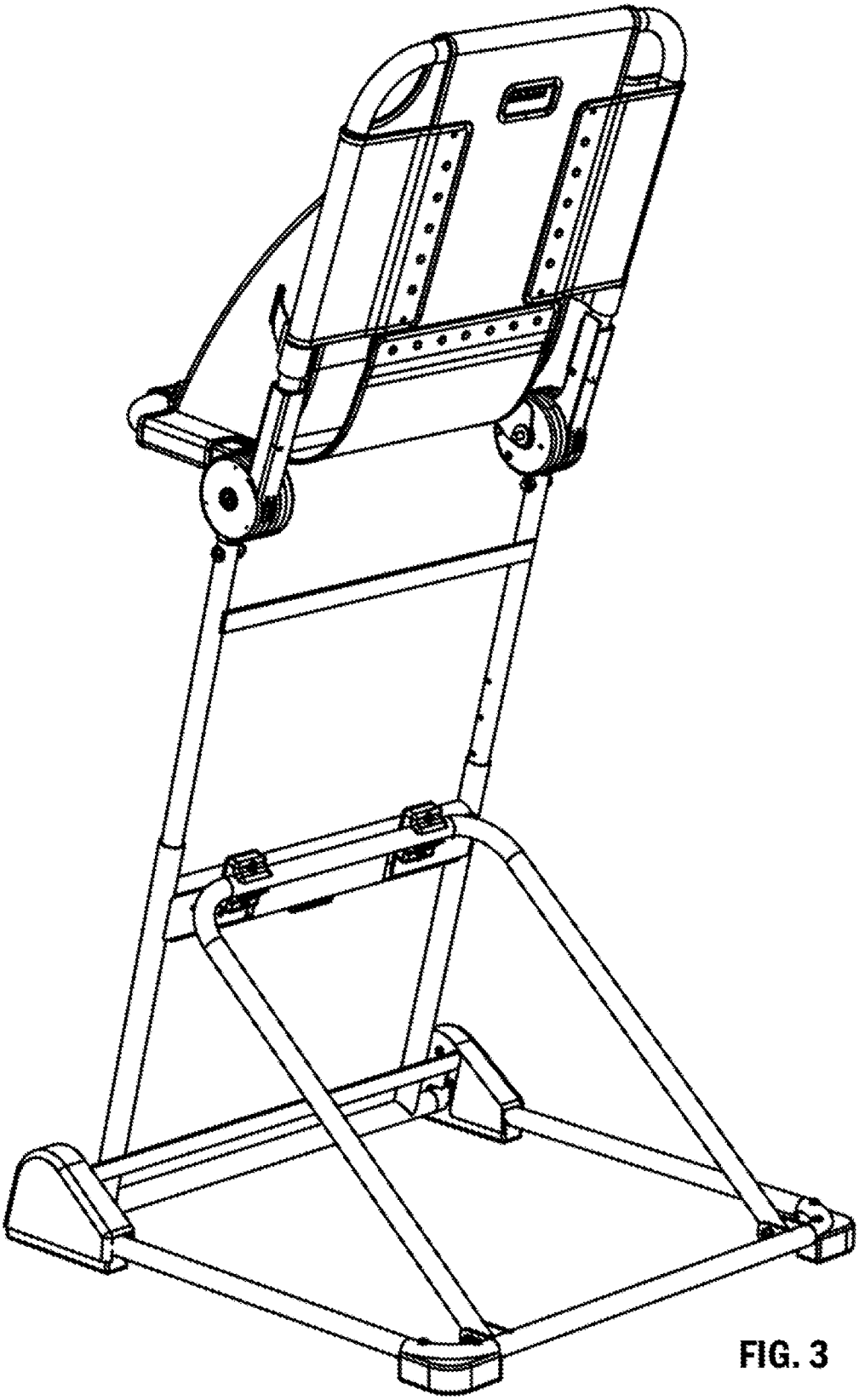
FIG. 3 is a rear left isometric perspective view of a collapsible and height adjustable shower chair device, as contemplated by the present disclosure.
Figure 4:
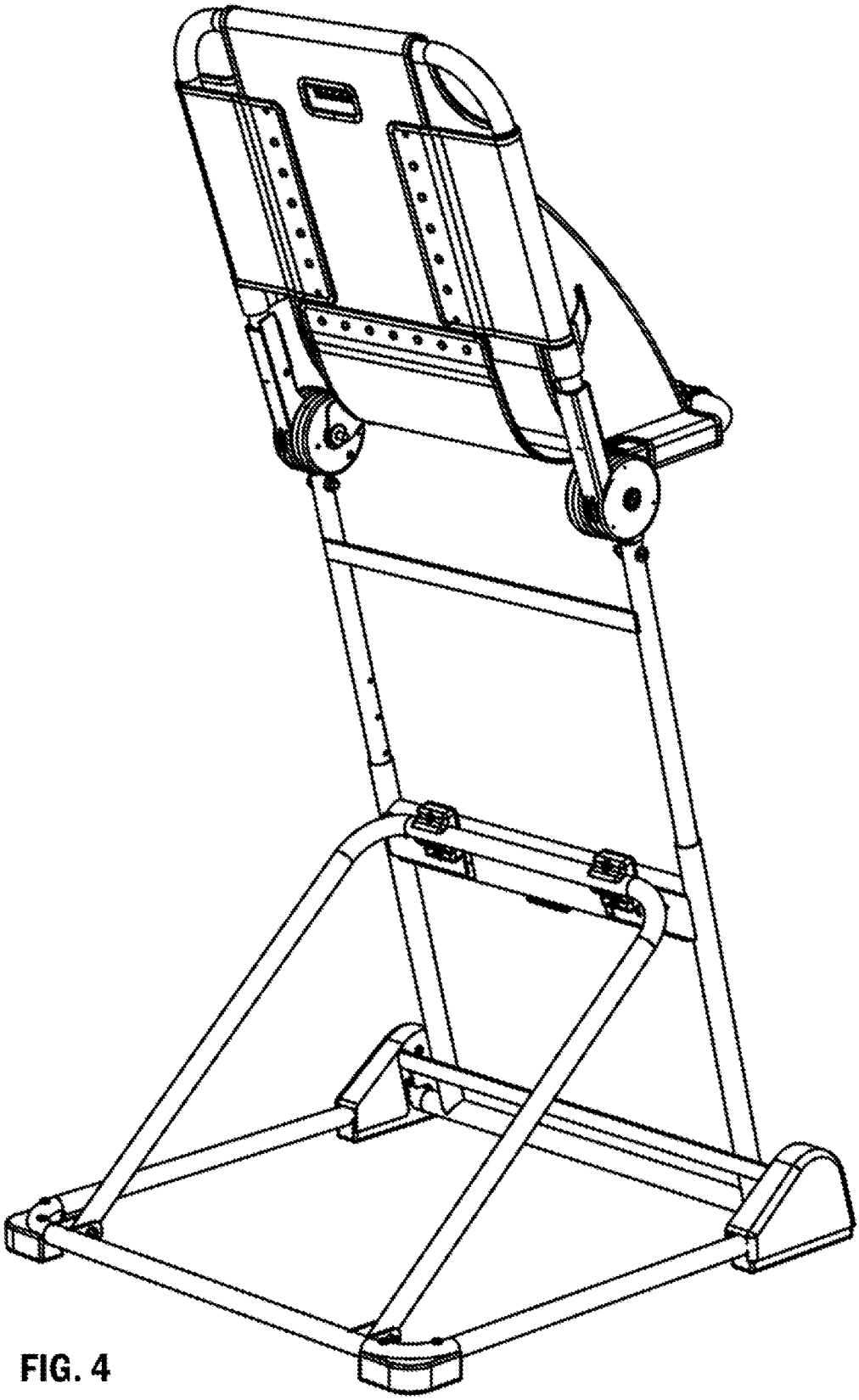
FIG. 4 is a rear right isometric perspective view of a collapsible and height adjustable shower chair device, as contemplated by the present disclosure.
Figure 5:
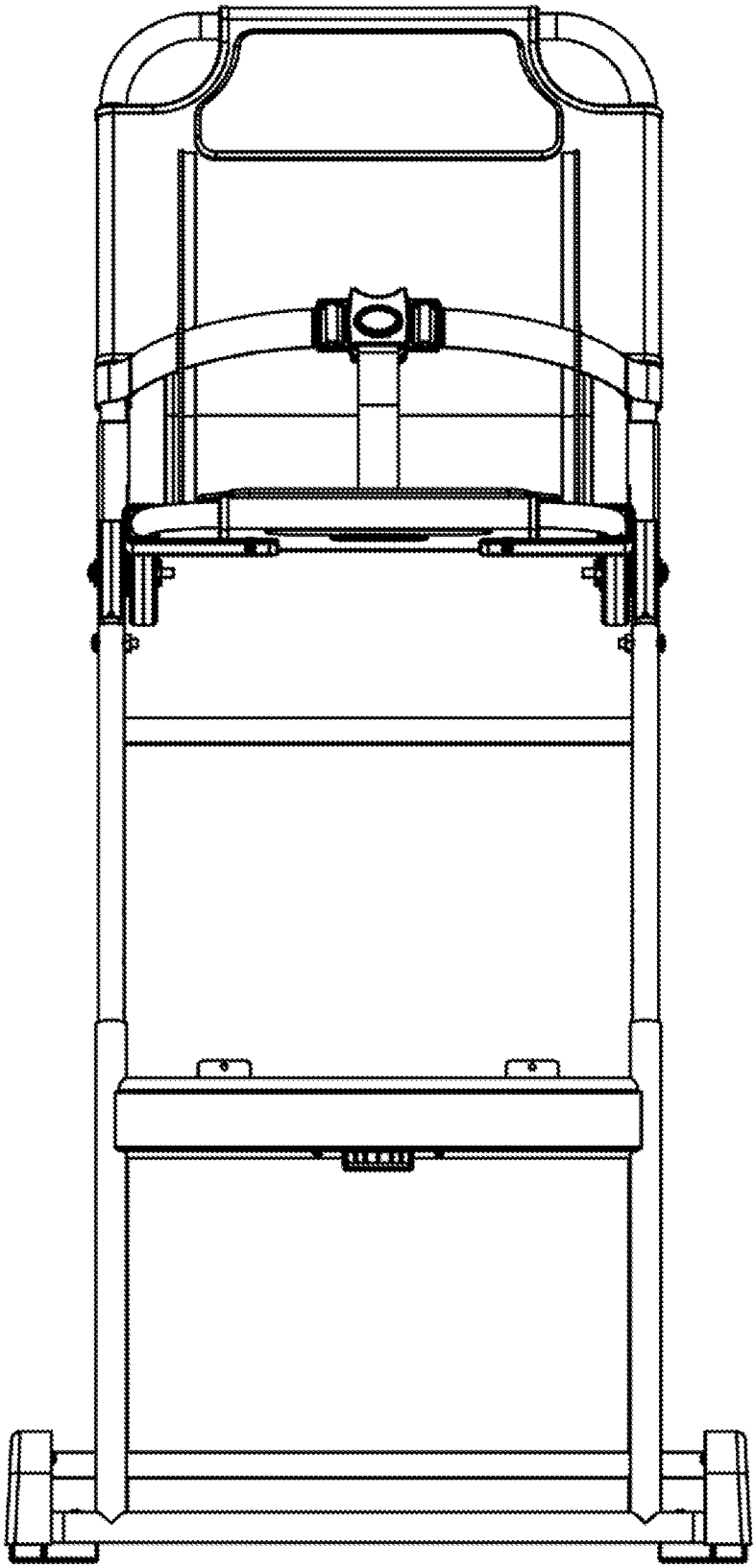
FIG. 5 is a front elevation view of a collapsible and height adjustable shower chair device, as contemplated by the present disclosure.
Figure 6:
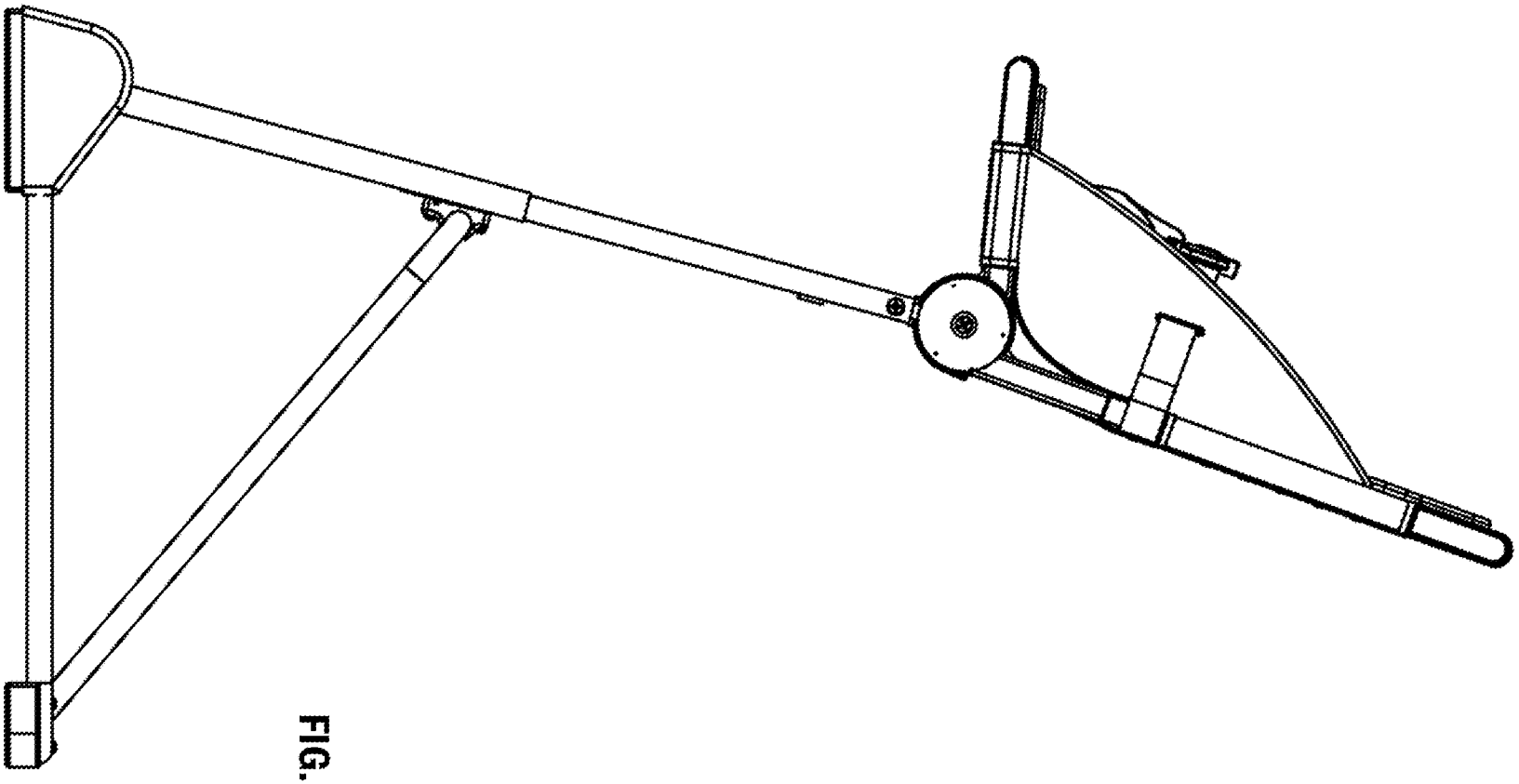
FIG. 6 is a left side elevation view of a collapsible and height adjustable shower chair device, as contemplated by the present disclosure.
Figure 7:
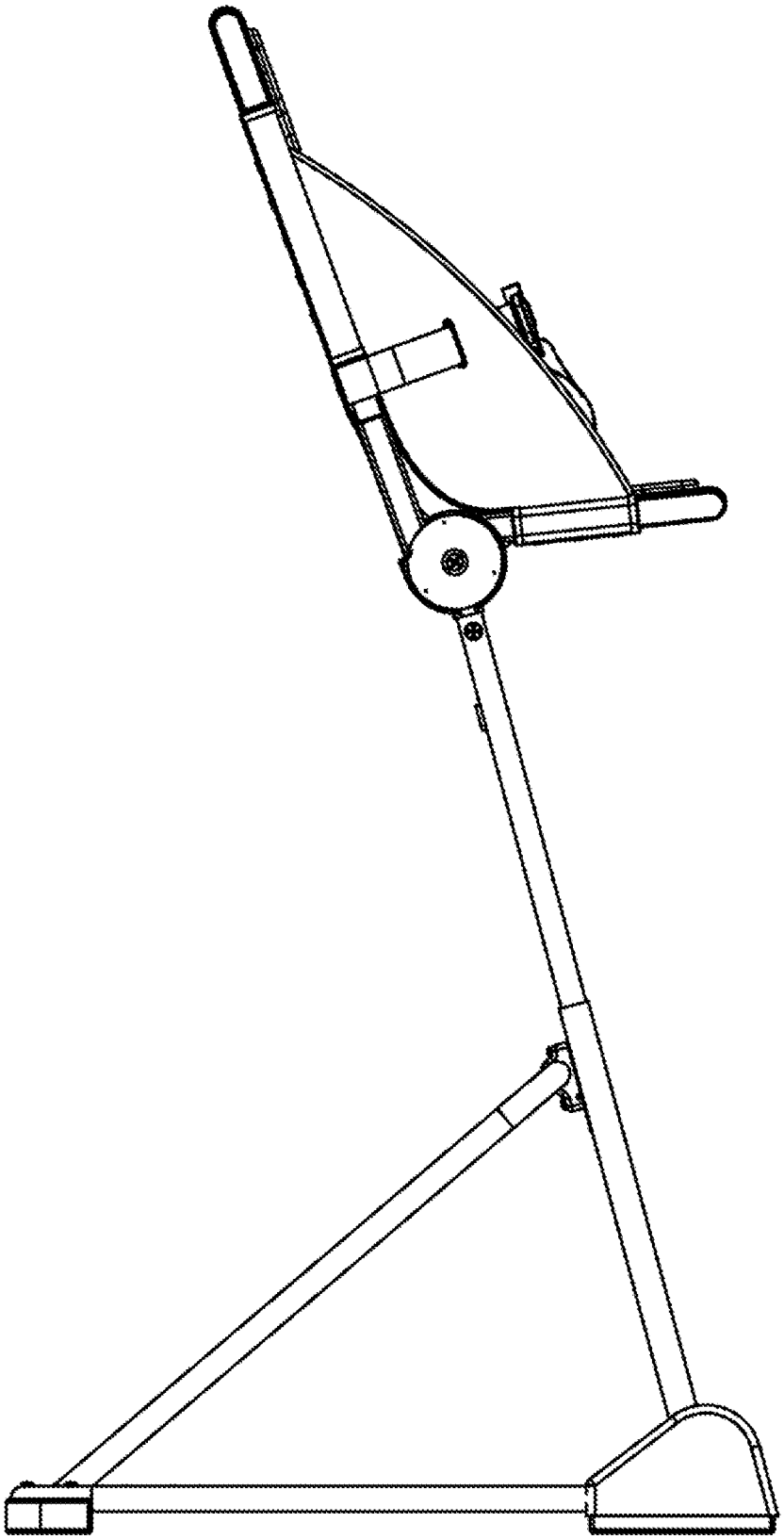
FIG. 7 is a right side elevation view of a collapsible and height adjustable shower chair device, as contemplated by the present disclosure.
Figure 8:
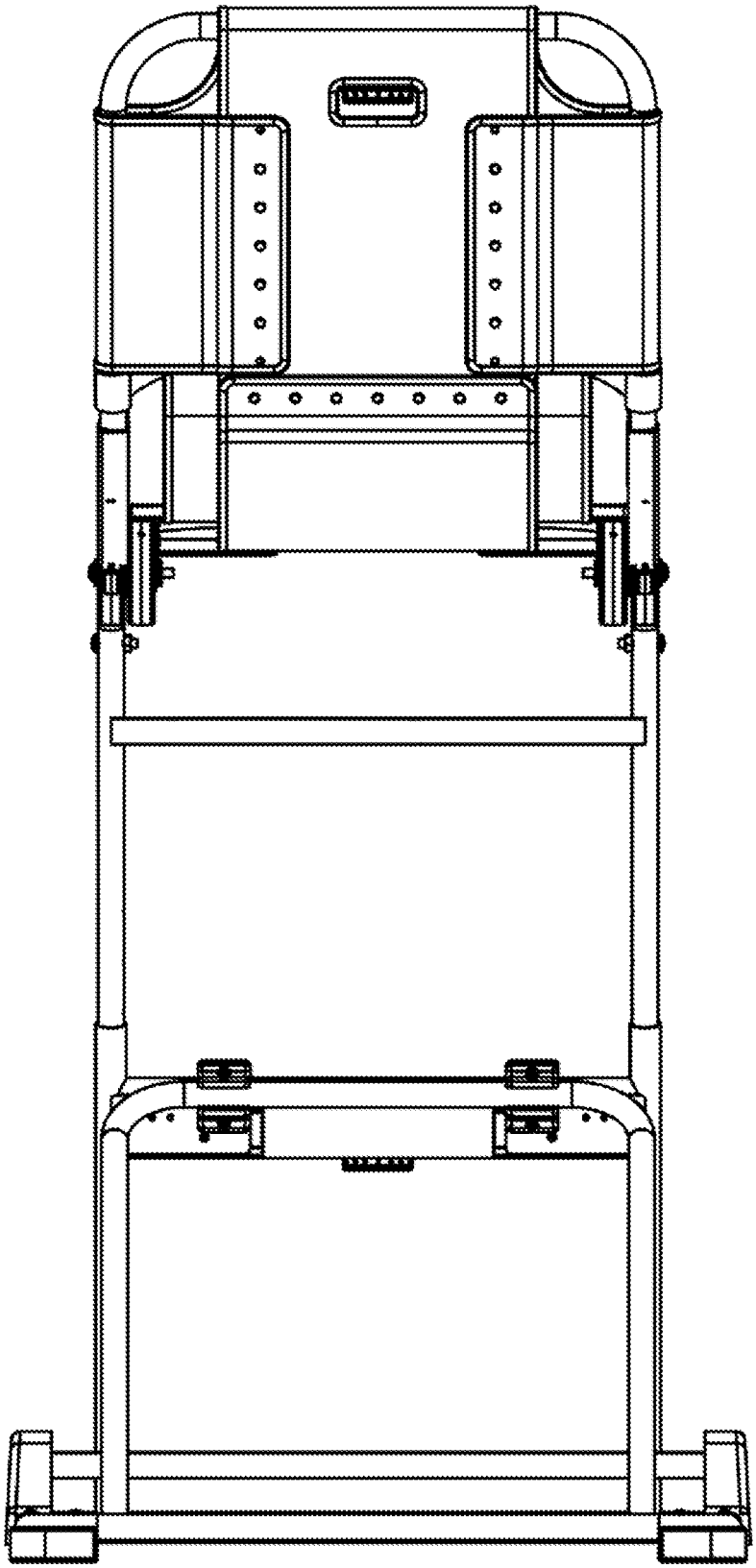
FIG. 8 is a rear elevation view of a collapsible and height adjustable shower chair device, as contemplated by the present disclosure.
Figure 9:
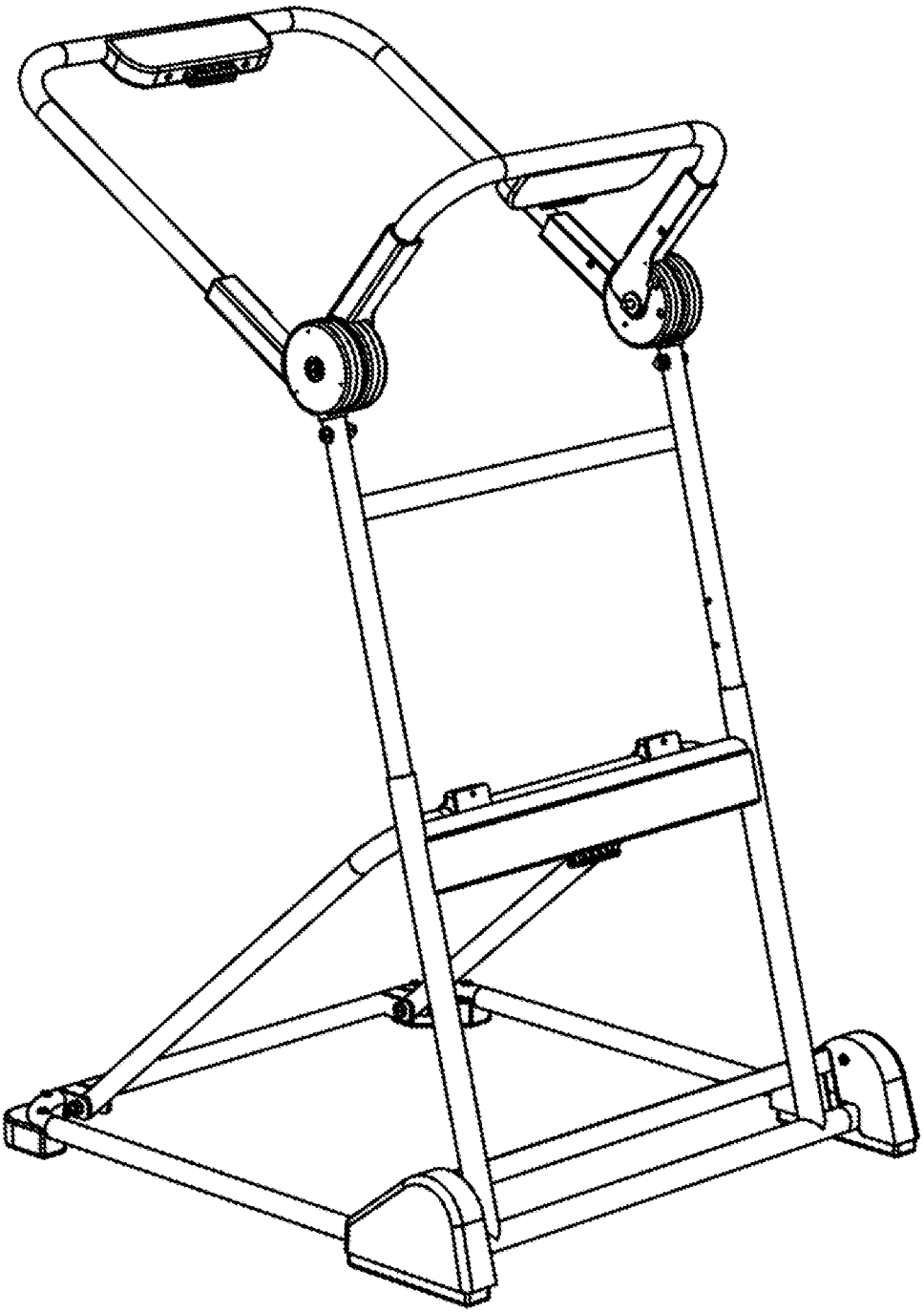
FIG. 9 is a front left isometric perspective view of a collapsible and height adjustable shower chair device with seat assembly removed, as contemplated by the present disclosure.
Figure 10:
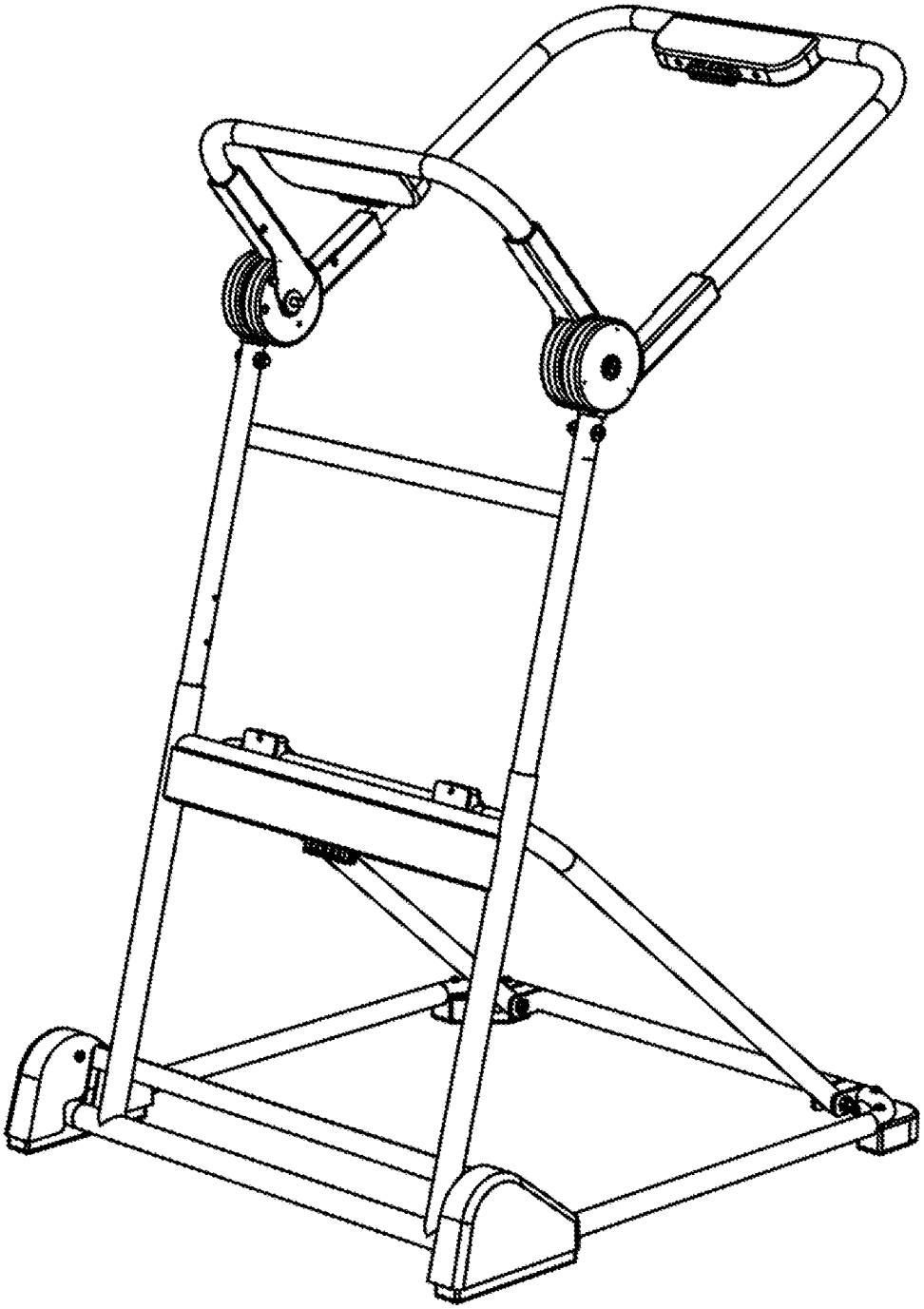
FIG. 10 is a front right isometric perspective view of a collapsible and height adjustable shower chair device with seat assembly removed, as contemplated by the present disclosure.
Figure 11:
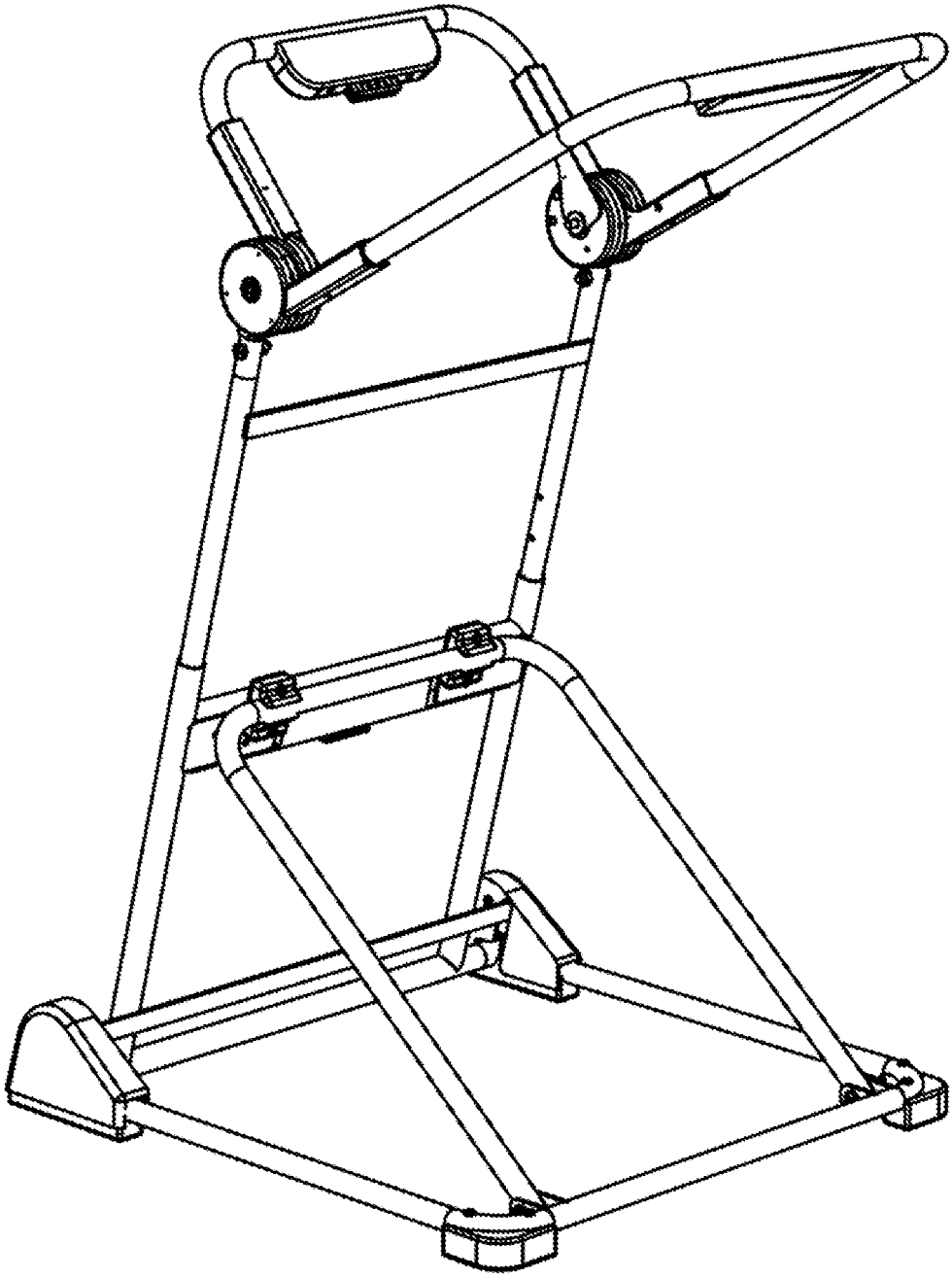
FIG. 11 is a rear right isometric perspective view of a collapsible and height adjustable shower chair device with seat assembly removed, as contemplated by the present disclosure.
Figure 12:
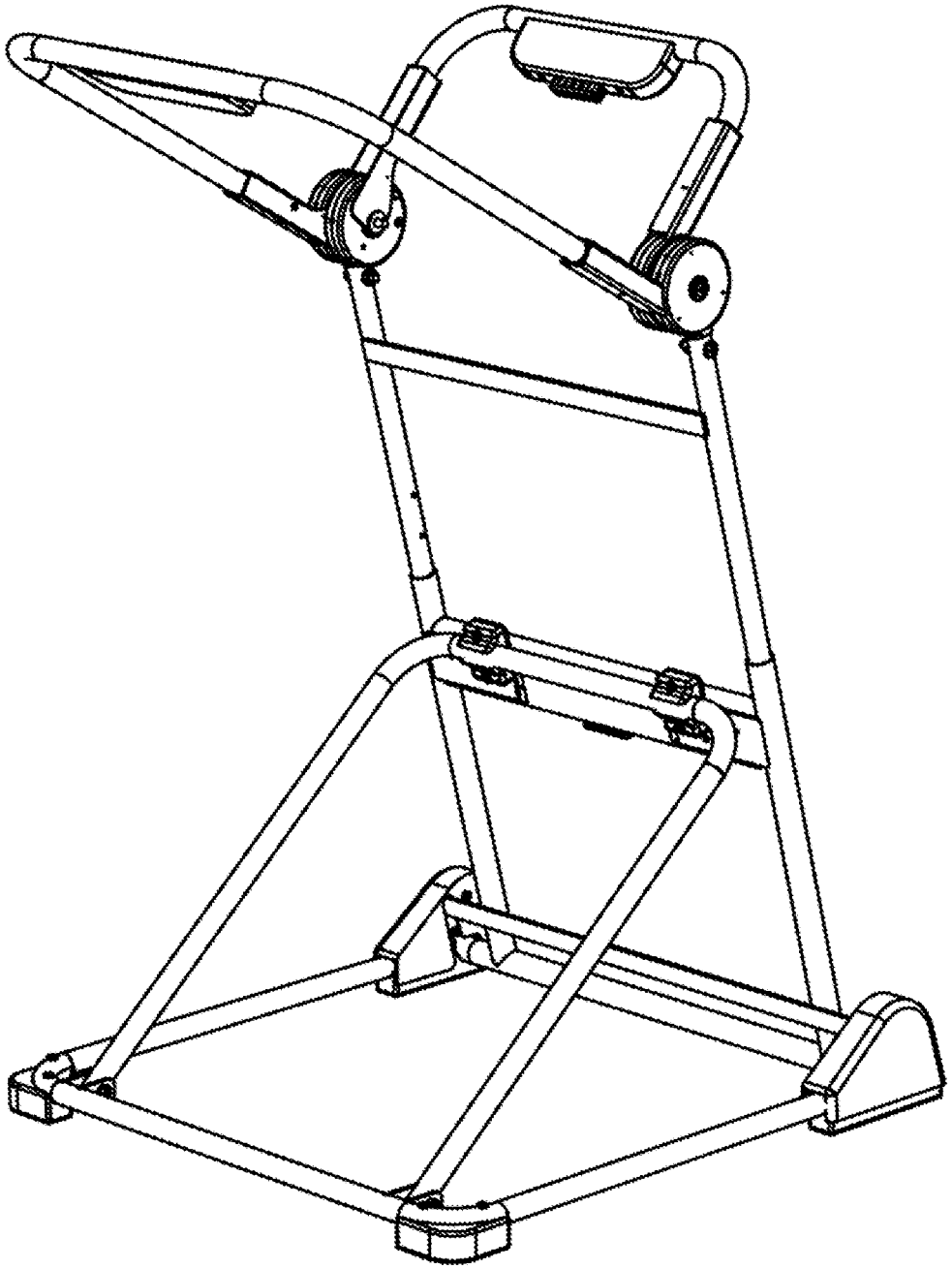
FIG. 12 is a rear left isometric perspective view of a collapsible and height adjustable shower chair device with seat assembly removed, as contemplated by the present disclosure.
Figure 13:
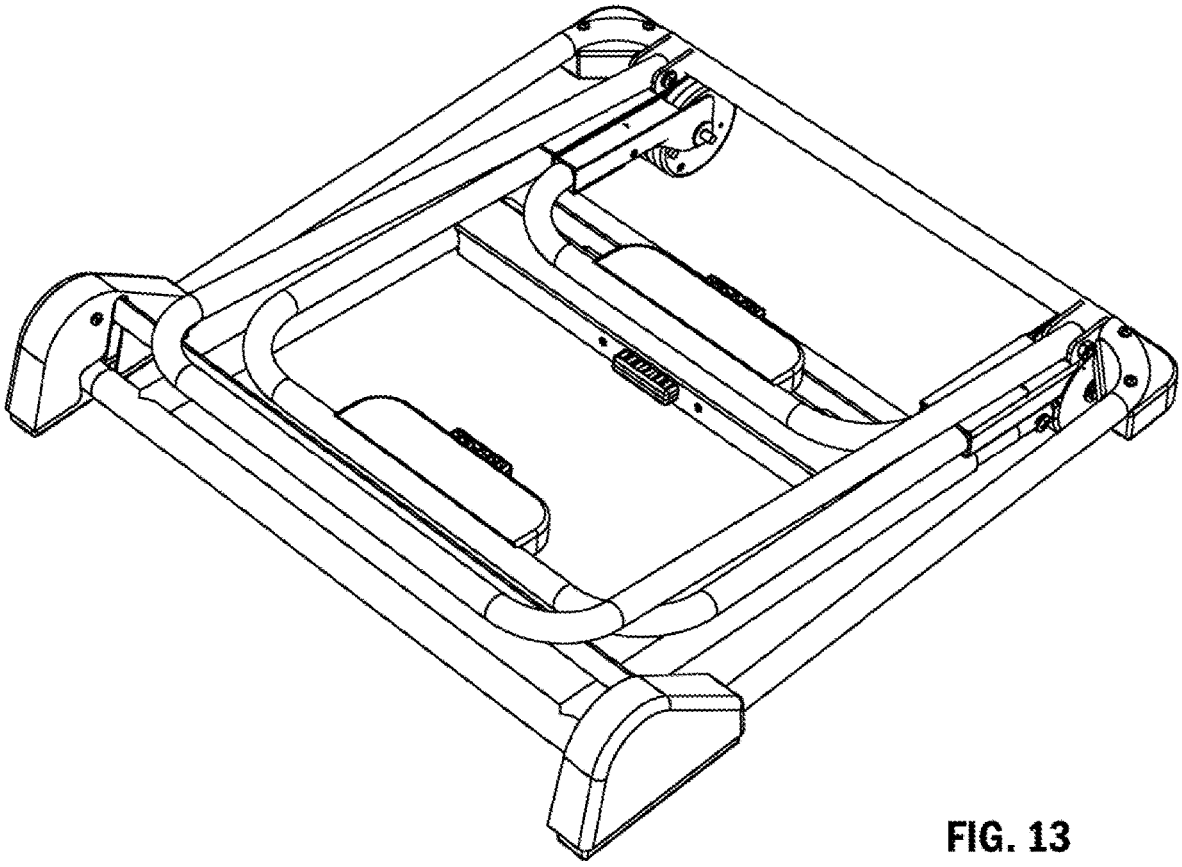
FIG. 13 is an isometric perspective view of a collapsible and height adjustable shower chair device in a collapsed orientation, as contemplated by the present disclosure.

The illustrations of FIGS. 1-13 illustrate a collapsible and height adjustable shower chair device, as contemplated by the present disclosure. The device may comprise, generally, a main body 100 further comprising a seat assembly 110 mounted to a seat frame 130. The main body 100 may comprise, generally, a chair having a side-z profile.

The seat assembly 110 may comprise, generally, a foldable seat comprising a base frame 112 and a back frame 114 connected to each other by a plurality of seat hinges 116. The base frame 112 and the back frame 114 may comprise any appropriate shape, size, or cross section. In one embodiment the base frame 112 and the back frame 114 may substantially comprise tubular u-shaped frames having a circular cross-section. The plurality of seat hinges 116 may comprise, generally, articulating hinges that receive the ends of the base frame 112 and the back frame 114 and allow the articulation of the base frame 112 and the back frame 114 relative to each other through a range of zero degrees and one hundred and eighty degrees.

The seat assembly 110 may further comprise a fabric seat, which may comprise a seat back 118 installed on the back frame 114 and a seat base 120 installed on the base frame 112. The fabric seat may comprise a single piece of material or multiple pieces of material, as desired, and may generally comprise a flexible and waterproof material of construction that is comfortable on bare skin so as not to cause irritation to a user of the device.

The seat base 120 may further comprise a plurality of perforations to allow for drainage of water from the seat assembly 110, and the seat base 120 and seat back 118 may be attached to one another by a plurality of seat sides 124. The plurality of seat sides 124 may comprise any appropriate shape, size, or cross section. In one embodiment the plurality of seat sides 124 may substantially comprise triangular sections of flexible and waterproof material of construction connected to the seat base 120 and seat back 118 so as to provide lateral limits to the seat assembly 110. The seat assembly 110 may further comprise a seat belt 126, which may comprise any appropriate seat belt such as, for example, a three-point harness with a quick-release locking mechanism.

The seat frame 130 may comprise, generally, a foldable and height adjustable frame comprising a plurality of upper legs 132, a plurality of lower legs 134, a bottom frame 136, and a plurality of hinges. The plurality of upper legs 132, plurality of lower legs 134, and bottom frame 136 may comprise any appropriate shape, size, or cross section. In one embodiment the plurality of upper legs 132 and plurality of lower legs 134 may substantially comprise straight tubular frames having a circular cross-section, and the bottom frame 136 may substantially comprise a tubular u-shaped frame having a circular cross-section.

The plurality of upper legs 132 may be attached to a plurality of frame upper hinges 140 at an upper end, which may be connected to one another by a crossmember. The plurality of upper legs 132 may comprise a locking mechanism at a lower end, which may be inserted into an upper end of the plurality of lower legs 134. The plurality of lower legs 134 may further comprise a plurality of height locks 146 so that the locking mechanism of the plurality of upper legs 132 may be locked at a desired length relative to the plurality of lower legs 134. In this way the overall length of the combination of the plurality of upper legs 132 and the plurality of lower legs 134 may be adjusted as desired. The locking mechanism may be any appropriate mechanism such as, for example, a button lock.

The plurality of lower legs 134 may be connected to the bottom frame 136 by a plurality of frame lower hinges 138. The plurality of frame lower hinges 138 may comprise, generally, articulating hinges that receive the lower end of the plurality of lower legs 134 and the ends of the bottom frame 136 and allows the articulation of the plurality of lower legs 134 and the bottom frame 136 relative to each other through a range of zero degrees and one hundred and eighty degrees.

The seat frame 130 may further comprise a plurality of feet to allow for additional stability and traction of the device. By way of example, the plurality of frame lower hinges may further comprise a plurality of angled feet 142, which may provide lateral or longitudinal support to prevent the device from falling over in a desired direction. The bottom frame 136 may further comprise a plurality of traction feet 144, which may provide traction and lateral or longitudinal support to prevent the device from moving on a wet surface or from falling over in a desired direction.

The seat assembly 110 may be attached to the seat frame 130 by any appropriate mechanism. By way of example, the base frame 112 of the seat assembly 110 may be attached to the upper crossmember of the seat frame 130, or may be rotatably attached to the plurality of frame upper hinges 140 such that the seat assembly 110 may articulate relative to the seat frame 130. In one embodiment the base frame 112 of the seat assembly 110 may be fixedly attached to the upper crossmember of the seat frame 130, and the upper crossmember of the seat frame 130 may rotate within the plurality of frame upper hinges 140. In this way the seat assembly 110 may be collapsed and the seat frame 130 may be collapsed, and the collapsing of both components results in the device having a relatively compact form factor.

The various hinges of the device may comprise any appropriate hinges suitable for allowing the relative articulation of those components attached to the particular hinge. The various hinges may further comprise locking and unlocking mechanisms so that the relative articulation of the components may be locked into place or released to permit a change in articulation. By way of example, the locking mechanism may be a geared, grooved, or toothed mechanism that further comprises a release button to reversibly engage the hinge and lock in a particular angle of articulation.

The collapsible and height adjustable shower chair device may be substantially constructed of any suitable material or combination of materials, but typically is constructed of a resilient material or combination of materials such that the device is resistant to damage as a result of compression, twisting, heating, or submersion in water. As an example, and without limiting the scope of the present invention, various exemplary embodiments of the collapsible and height adjustable shower chair device may be substantially constructed of one or more materials of silicone, plastic, acrylic, polycarbonate, steel, aluminum, brass, fiberglass, carbon fiber, or combinations thereof. In some embodiments the various components of the device may be coated, lined, or otherwise insulated to prevent contamination of the device.

In one embodiment the collapsible and height adjustable shower chair device may comprise a resilient material of construction that either comprises a material having antimicrobial properties or comprises a layering of antimicrobial material or coating. Antimicrobial properties comprise the characteristic of being antibacterial, biocidal, microbicidal, anti-fungal, anti-viral, or other similar characteristics, and the oligodynamic effect, which is possessed by copper, brass, silver, gold, and several other metals and alloys, is one such characteristic. Copper and its alloys, in particular, have exceptional self-sanitizing effects. Silver also has this effect, and is less toxic to users than copper. Some materials, such as silver in its metallic form, may require the presence of moisture to activate the antimicrobial properties.

While the invention has been described in connection with what is presently considered to be the most practical and preferred embodiments, it is to be understood that the invention is not to be limited to the disclosed embodiments, but, on the contrary, is intended to cover various modifications and equivalent arrangements included within the spirit and scope of the appended claims.

I claim:

1. A collapsible and height adjustable shower chair device, comprising:

a seat assembly; and a seat frame;

wherein said seat assembly further comprises a base frame, a back frame, and a plurality of seat hinges;

wherein said base frame further comprises a u-frame;

wherein said back frame further comprises a u-frame;

wherein said base frame is attached at a plurality of legs to said plurality of seat hinges;

wherein said back frame is attached at a plurality of legs to said plurality of seat hinges;

wherein said plurality of seat hinges allow said base frame to reversibly articulate relative to said back frame between an angle of zero degrees and one hundred and eighty degrees;

wherein seat frame further comprises a plurality of upper legs, a plurality of lower legs, a bottom frame, a plurality of frame upper hinges, and a plurality of frame lower hinges;

wherein said plurality of upper legs and said plurality of lower legs comprise tubular rods;

wherein said plurality of upper legs further comprise a plurality of locking mechanisms;

wherein said plurality of lower legs further comprise a plurality of height locks;

wherein said plurality of upper legs are inserted into said plurality of lower legs;

wherein said bottom frame further comprises a u-frame;

wherein said plurality of upper legs are attached at an upper end to said plurality of frame upper hinges;

wherein said plurality of lower legs are attached at a lower end to said plurality of frame lower hinges;

wherein said bottom frame is attached at a plurality of legs to said plurality of frame lower hinges;

wherein said plurality of frame lower hinges allow said bottom frame frame to reversibly articulate relative to said plurality of lower legs between an angle of zero degrees and one hundred and eighty degrees; and wherein said seat assembly is attached to said seat frame.

2. The invention of claim 1, further comprising:

a fabric seat;

wherein said fabric seat is attached to said base frame and said back frame.

3. The invention of claim 2, further comprising:

a plurality of seat sides;

wherein said plurality of seat sides are attached to said fabric seat.

4. The invention of claim 3, further comprising:

a seat belt;

wherein said seat belt is attached to said seat assembly.

5. The invention of claim 4, further comprising:

a plurality of angled feet;

wherein said plurality of angled feet are attached to said plurality of frame lower hinges.

6. The invention of claim 4, further comprising:

a plurality of traction feet;

wherein said plurality of traction feet are attached to said bottom frame.

* * * * *